United States Patent [19]

Thompson et al.

[11] Patent Number: 4,895,205

[45] Date of Patent: Jan. 23, 1990

[54] PIPE WASHER AND CHEMICAL APPLICATOR SYSTEM

[76] Inventors: J. P. Thompson, Rte. 1, Box 792 "A", Moselle, Miss. 39459; Henry Guillory, 205 Alcide Dr., Abbeville, La. 70510; Alfred J. Thomas, II, 136 Teche Dr., Lafayette, La. 70503

[21] Appl. No.: 110,371

[22] Filed: Oct. 19, 1987

[51] Int. Cl.[4] ..... E21B 19/00

[52] U.S. Cl. ..... 166/90; 166/82; 166/92; 166/311; 175/84

[58] Field of Search ..... 166/81, 82, 83, 88, 166/90, 92, 93, 118, 310, 311; 175/84

[56] References Cited

U.S. PATENT DOCUMENTS

| | | | |
|---|---|---|---|
| 4,004,326 | 1/1977 | Beavers | 175/325 X |
| 4,042,023 | 8/1977 | Fox | 175/325 X |
| 4,198,789 | 4/1980 | Wheeler | 175/84 X |
| 4,279,300 | 7/1981 | Wirsch | 175/84 X |
| 4,494,607 | 1/1985 | Ford et al. | 166/311 |
| 4,619,321 | 10/1986 | Molina | 166/90 |

FOREIGN PATENT DOCUMENTS

| | | | |
|---|---|---|---|
| 0578442 | 10/1977 | U.S.S.R. | 166/82 |

*Primary Examiner*—William P. Neuder
*Attorney, Agent, or Firm*—Pravel, Gambrell, Hewitt, Kimball & Krieger

[57] ABSTRACT

A system for washing, cleaning, and chemically treating sections of drill pipe being tripped out of the hole, which includes an elongated cylindrical housing having a central opening therethrough, the housing comprised of a first and second semi-circular sections, the sections movable between open and closed positions by a hinged joint along one edge, and in the closed position maintained closed via a locking member along the second edge. Within the housing there is further included upper and lower wipers, which comprise circular rubberized material having bores along their central axes, the bores being substantially the width of a section of drill pipe to clean the wall of the pipe. Each wiper would be spaced apart from one another and housed within an annular channel along the inner surface of the housing so that the wipers would be stationary within the housing as the housing is placed in the closed position. There is provided spray nozzles for providing pressurized spray of water and anti-corrosive compound for coating the pipe wall.

13 Claims, 3 Drawing Sheets

PIPE WASHER AND CHEMICAL APPLICATOR SYSTEM

BACKGROUND OF THE INVENTION

1. Field of the Invention

The present invention relates to cleaning of drill pipe. More particularly, the present invention relates to a system for wiping, washing, and chemically treating drill string pipe as it is tripped out of the hole.

2. General Background

In the drilling of oil wells, the drill string is comprised of a plurality of sections of drill pipe threaded together end to end to make up the continuous string. From time to time, for various reasons, for example, to change the bit at the end of the string, the string must be raised or "tripped" out of the hole in order to have access to the drill bit. When the pipe is brought out of the hole, the various sections are removed from the string in view of the fact that often times the string may be thousands of feet long. During the process of drilling, it is necessary that the cuttings formed from the drill bit be removed from the hole, and that the well head be maintained under a certain hydrostatic pressure. Therefore, drilling mud is circulated down through a bore in the drill pipe, and is recirculated up the hole in the annular space between the drill pipe and the hole drilled by the bit. As the string is removed from the hole, the string will carry with it mud that is surrounding it as the drilling is going forth, therefore the result is that the mud, whether it be water based or oil based is lodged onto the surface of the drill pipe, as the pipe is brought up.

In the present state of the art, the roughneck on the rig washes down the pipe with a hose or the like in order to attempt to wash the mud from the surface so that mud is not carried up as the sections of the pipe are broken apart. This however, leads to (a) a loss in the valuable drilling mud that is utilized in the drilling process, and (b) casting off of mud on the rig floor or in the area of the blow-out preventers, which is not in keeping with the proper maintenance of the rig.

Therefore, there is a need in the art for an apparatus for system which would (a) clean excess mud from the surface of the drill pipe as it is tripped out of the hole, (b) cleaning of the surface following the removal of the mud, and (c) undertaking chemical treatment of the surface of the drill pipe to reduce the corrosive effects of the chemicals in the mud.

The following patents were obtained as a result of a search conducted, and are relevant to the art of cleaning of drill pipe.

| PATENT NO. | INVENTOR | TITLE |
|---|---|---|
| 4,503,577 | Fowler | "Pipe And Hose Decontamination Apparatus" |
| 4,600,444 | Miner | "Pipe End Area Cleaning System" |
| 2,960,706 | Dunham | "Pile Cleaning And Treatment Device" |
| 4,157,096 | Miller, Jr. | "Apparatus For Cleaning Threaded Pipe Ends" |
| 4,011,617 | Toelke, et al | "Cleaner For Tubular Pin And Box Ends" |
| 3,971,442 | Scott | "Method Of Cleaning Tubular Members On A Rig Floor" |
| 4,457,366 | Brown | "Wiper Device For Stripping Fluid From Well Pipe" |
| 4,406,331 | Bentley | "Pipe Wiper" |

SUMMARY OF THE PRESENT INVENTION

The system of the present invention solves the shortcomings in the art in a simple and straightforward manner. What is provided is a system for washing, cleaning, and chemically treating sections of drill pipe being tripped out of the hole, the system including an elongated cylindrical housing having a central opening therethrough, the housing comprised of a first and second semi-circular sections, the sections movable between open and closed positions by a hinged joint along one edge, and in the closed position, maintained closed via a locking member along the second edge. Within the housing there is further included a upper and lower wipers, which comprise circular sections of rubberized material having a bore through its central axis through which the sections of pipe travel during the cleaning process, the bore being of a width so as to frictionally engage and wipe the wall of a section of drill pipe. Each wiper would be spaced apart from one another and housed within an annular channel along the inner surface of the housing so that the wipers would be stationary within the housing as the housing is placed in the closed position.

Further, there is included an annular trough positioned along the inner wall of the housing, each trough located directly below each of the respective circular wipers, so that any fluid or the like which would flow off of the wipers would be caught within the trough. Each trough would be opened to a port in the wall of the housing for allowing fluid flow from the trough into a flow line to flow excess fluids out of the housing during use of the system. Further, there would be included a plurality of jets positioned along the interior wall of the housing directly above each of the respective wipers, so that as pipe is moved through the bore in the wipers, that portion of the pipe moving upward from the wiper would be sprayed either with water as it would move from the lower wiper for cleaning the pipe, or with a chemical anti-corrosion compound as the section of pipe being cleaned leaves the bore of the upper wiper.

In addition, there would be included water flow lines providing water pumped under pressure to the various nozzles above the lower wiper for pumping water under pressure into the system, and a chemical flow line to the nozzles above the upper wiper for providing a chemical spray pumped under pressure to the wall of the pipe as it moves through the wipers.

Therefore, it is a principal object of the present invention to provide a system positionable along a drill string for wiping, washing, and chemically treating sections of the string as they are tripped out of the hole;

It is still a further principal object of the present invention to provide a system which incorporates a housing around a drill string for cleaning the string as it is tripped out of the hole;

It is still a further object of the present invention to provide a system which can be positioned along a drill string above the bell nipple so that any mud which is carried to the surface along the wall of sections of the string is wiped from the string and is allowed to fall back into the hole without contaminating the surrounding area.

BRIEF DESCRIPTION OF THE DRAWINGS

For a further understanding of the nature and objects of the present invention, reference should be had to the following detailed description, taken in conjunction with the accompanying drawings, in which like parts are given like reference and wherein.

DETAILED DESCRIPTION OF THE PREFERRED EMBODIMENT

Figure 1:
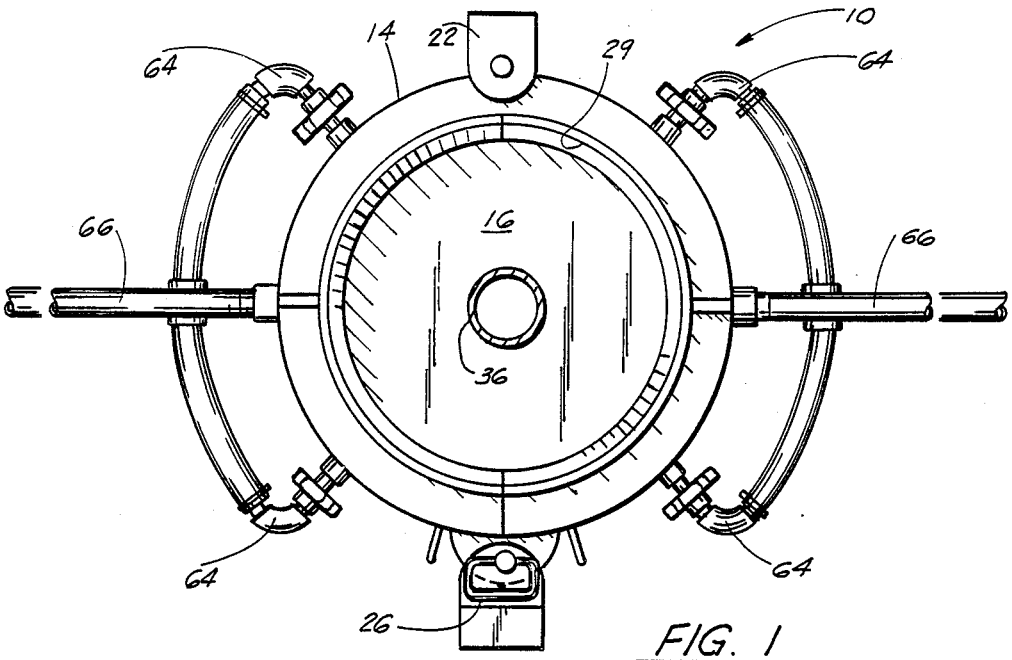
FIG. 1 is an overall top view of the preferred embodiment of apparatus of the present invention.

The system of the present invention is illustrated in the Figures by the numeral 10. System 10, as seen in the Figures would comprise an annular housing 12 having continuous circular wall portion 14, the wall portion 14 of the cylindrical housing defining a large bore 16 therethrough. The housing would comprise first and second semi-circular portions 18 and 20, the semi-circular portions movable between open and closed positions, via hinge member 22 along a first edge 24, and in a closed position, the housing would be held in the locked position via locking member 26 along a second edge 28, which is standard type locks found in the industry. While in the closed position, the portions 18 and 20, would define the circular elongated annular housing 12 in the Figures.

As seen in FIG. 1, housing 12 would include an inner wall 29 would further include a means for supporting wipers to wipe drill pipe 35 moving through housing 12. This means comprises a first annular channel 30 which would support a first lower wiper 32, wiper 32 comprising a circular ring member of thickened rubberized material, having a bore 34 through its central axis, the bore 34 being substantially the diameter of a section of drill pipe 35, and would allow the movement of drill pipe 35 therethrough, with the inner edge 36 of wiper 32 frictionally engaging and wiping the wall 37 of a section of drill pipe 35, the purpose of which will be described further.

Figure 6:
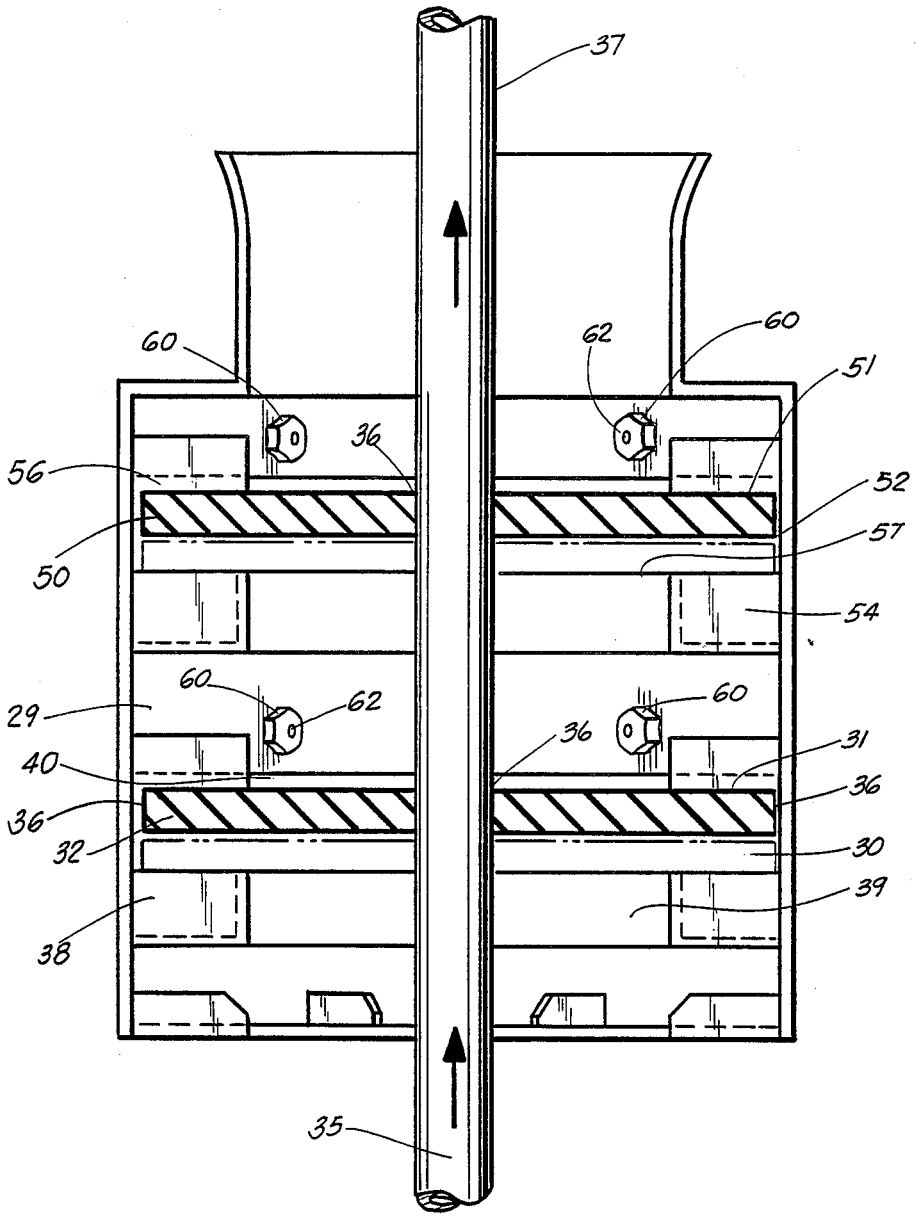
FIG. 6 is a cross-sectional view in the preferred embodiment of the apparatus of the present invention.

In the preferred embodiment, housing 12 would include a means for maintaining lower wiper 32 stationary within bore 16 of housing 12 in the closed position. This means would include a lower annular ledge 38 extending outwardly from the inner wall 29 of housing 12, and defining a means for lower wiper 32 to rest upon when housing 12 is in the closed position as seen in FIG. 6. In actuality, the lower ledge 38 would define a trough 39 for receiving fluids flowing off of the upper surface 31 of wiper 32, as will be discussed further. In addition, so that wiper 32 is maintained stationary as pipe is moved therethrough, there is included a second upper annular ledge 40, with upper ledge 40 and lower ledge 38 defining the annular channel 30 which houses lower wiper 32 when the apparatus is in the closed position, and maintains wiper 32 stationary as pipe 35 is moved therethrough. Likewise, as seen in the Figures, there is included an upper wiper 50, constructed of similar material and of similar structure as lower wiper 32, which likewise is housed within an annular channel 52 along the interior wall 29 of housing 12, annular channel 52 like annular channel 30, also defined by a lower annular ledge portion 54 and an upper annular ledge portion 56, again ledge portions 54 and 56 maintaining upper wiper 50 stationary as drill pipe 35 is moved therethrough. Again, lower ledge portion 56 supporting upper wiper 50 is in actuality an annular trough 57 for receiving fluids from the upper surface 51 of upper wiper 50, again the purpose of which will be described at this time.

As is further illustrated, directly above lower wiper 32 and upper wiper 50 respectively, there is positioned, as seen in the Figures, a plurality of nozzles 60, each nozzle 60 incorporated into the wall of the housing 12, and including a centrally located fluid spray port 62 for allowing fluid to be sprayed therefrom during use. As seen in the Figures, each of the nozzles 60 are positioned along the inner wall 29 of the housing 12, so that each nozzle 60 would spray fluid interiorly into bore 16 of housing 12, so that any drill pipe 35 moving therethrough would receive a spray of pressurized fluid along its wall for cleansing purposes.

Figure 2:
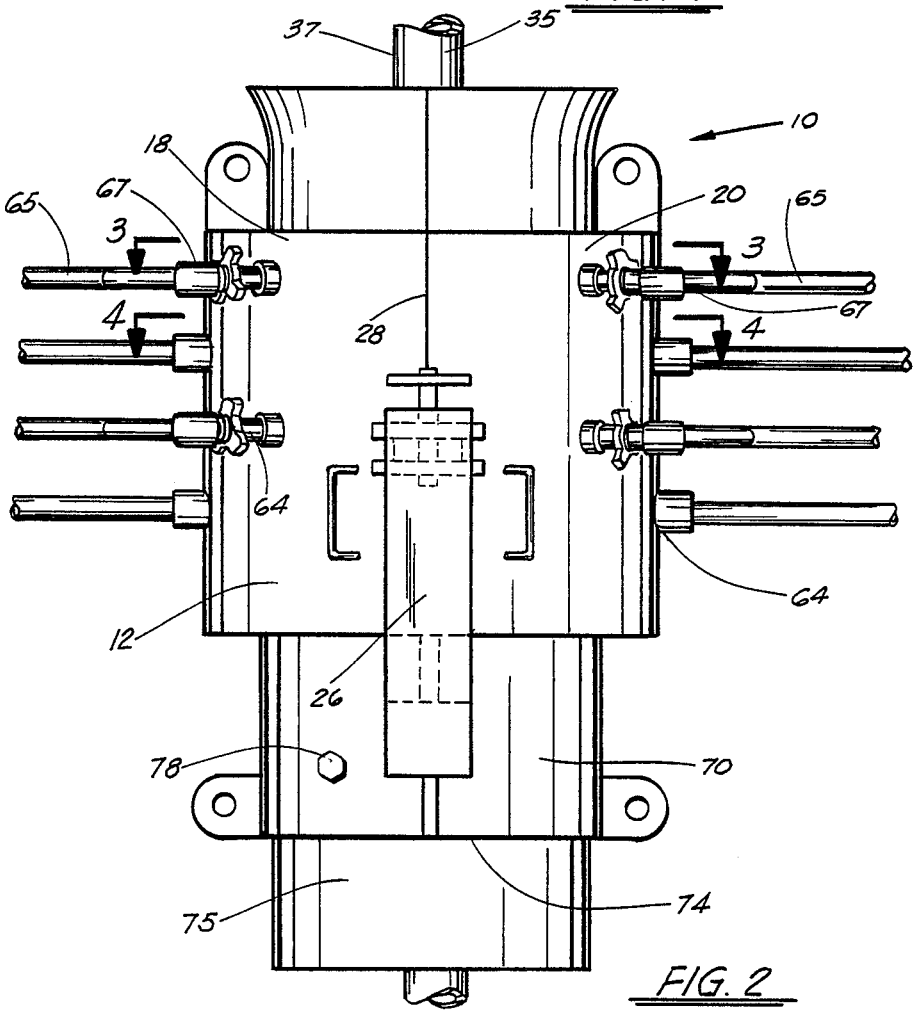
FIG. 2 is an overall side plan view of the preferred embodiment of the apparatus of the present invention.
Figure 3:
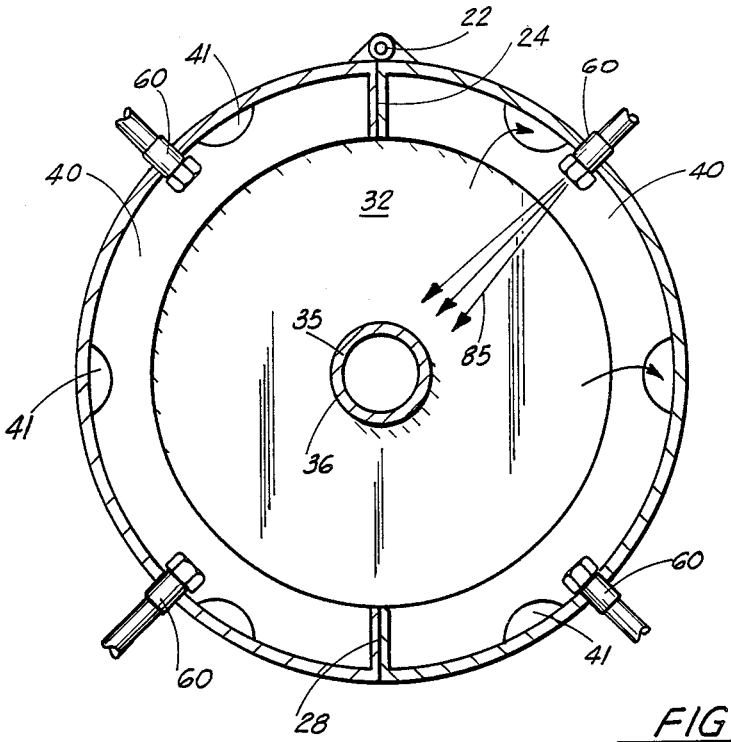
FIG. 3 is a top view along lines 3—3 of FIG. 2 of the preferred embodiment of the apparatus of the present invention.
Figure 4:
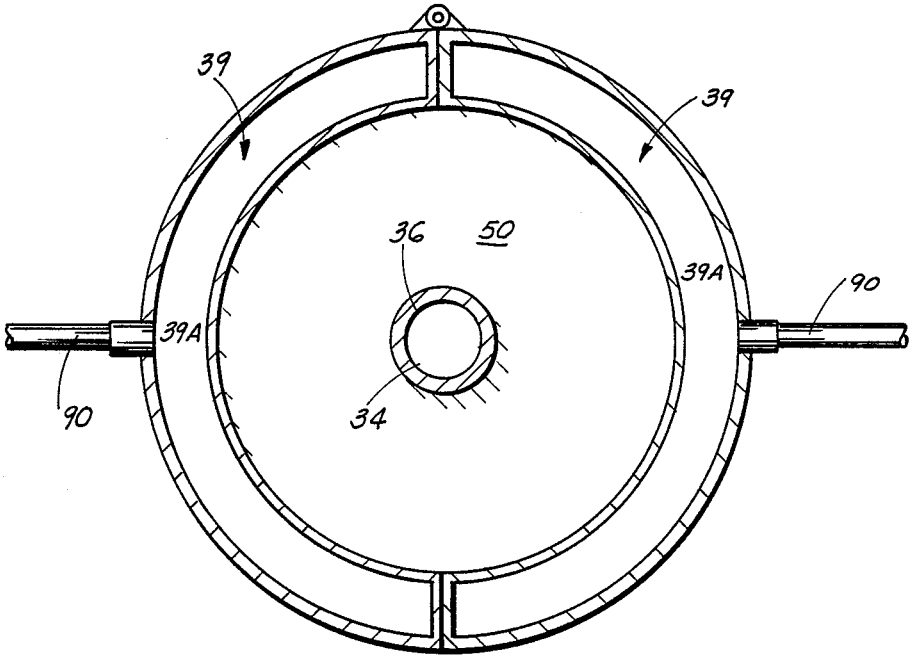
FIG. 4 is a top view along lines 4—4 in FIG. 2 of the preferred embodiment of the apparatus of the present invention.

As seen in FIGS. 2 and 3, each of the nozzles 60, is provided with a fluid flow line 64 from a common common flow line 66, so that fluid under pressure may be flowed into each nozzle 60 during use of the apparatus. For purposes of cleaning, the lower level 61 of nozzles 60 would spray a pressurized spray of water so that the pipe, after moving out of lower wiper 32, would first be washed with water via the lower nozzles 60, and following the pipe moving through the upper wiper 50, the upper level 63 of nozzles 60 would be provided with a pressurized stream of anti-corrosive chemical compound, from a common line 67 for spraying onto and coating the surface 37 of the section of pipe as it moves out of the apparatus, to prevent possible corrosion by any of the chemicals that may be maintained on the surface even after the surface has been wiped and washed during its movement through the apparatus.

For purposes of positioning, it is illustrated that housing 12 would include an annular mounting base 70, which has a continuous wall portion 72 defining an interior enlarged bore 74. Mounting base 70 would be of a diameter so that it would be positioned onto the bell nipple 75 located below the rig floor where the apparatus would be initially positioned. It would be maintained in place via bolt members 78 in the wall 72 of base 70, so that it would be securely held onto bell nipple 75 during operation of the apparatus.

OPERATION OF SYSTEM

Figure 5:
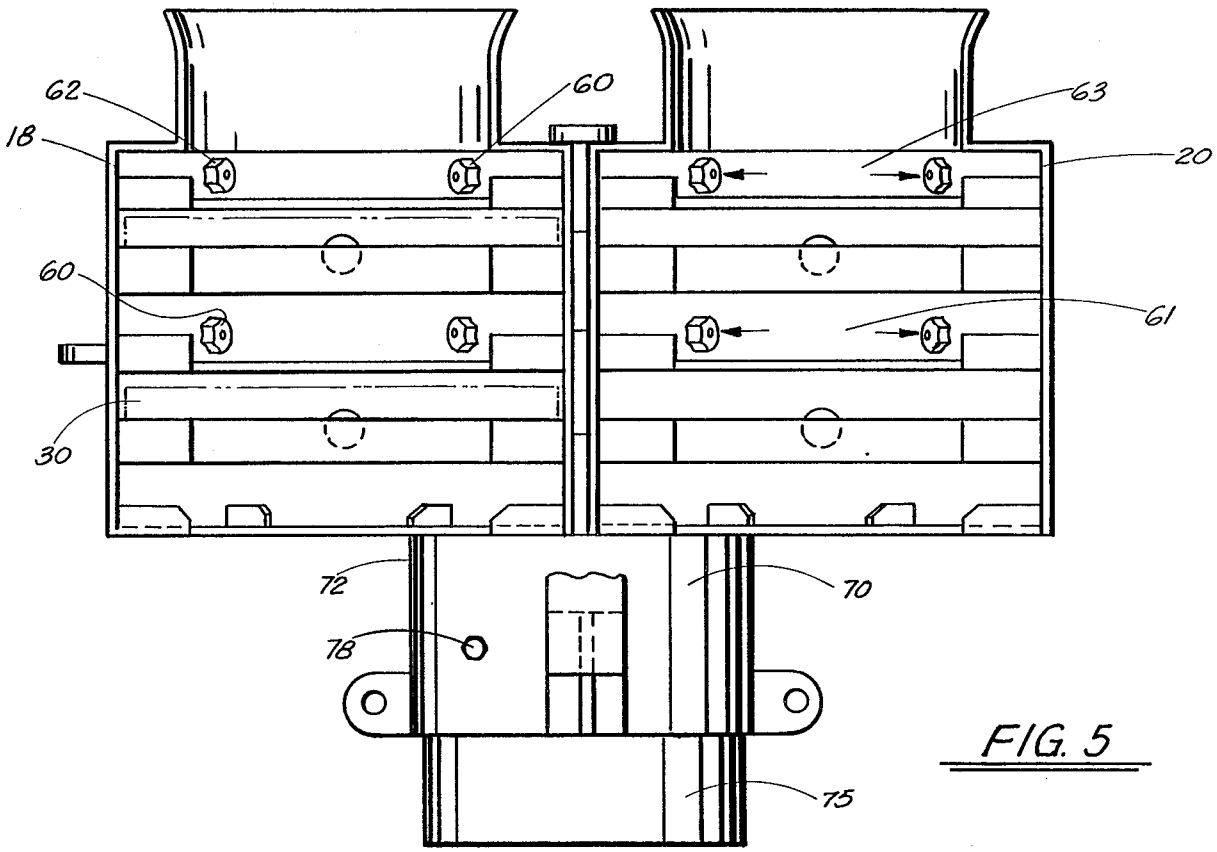
FIG. 5 is a view of the apparatus of the present invention in the open position.

As was stated earlier, housing 12 would be positioned vertically onto the bell nipple 75 beneath the rig floor 76, during retrieval of drill pipe from the bore hole. Because housing 12 may be opened and the wipers 32 and 50 removed, the housing while not being used, housing 12 may be placed onto the bell nipple 75 and be maintained in place during the entire drilling process, allowing the pipe to travel through bore 16 unobstructed. When in the course of drilling, the rig operator wishes to trip the drill pipe out of the hole, semi-circular portions 18 and 20 would be unlocked and placed in the open position as seen in FIG. 5. At that point, upper wiper 32 and lower wiper 50 would be placed into their respective channels 30 and 52, and the housing 12 would be closed and ready for use. As seen in the Figures, the flow line 66 flowing into the lines 64 to nozzles 60 in lower level 61 would be placed in the open position allowing water to flow into the nozzles 60 with the flow line 64 of upper level 63 receiving pressurized water flow, and the upper flow line 65 receiving pressurized chemical anti-corrosive compound flow. It should be noted that, not in all cases would the drill pipe 35 be required to receive the chemical treatment, and therefore in some cases the lower water nozzles 60 only, would be utilized in the operation.

At that point, the first section of drill pipe would be pulled through wipers 32 and 50, with lower wiper 32 achieving the principal purpose as the interior edge 36 of wiper 32 would frictionally engage the outer wall 37 of drill pipe 35 as it moved through the wiper. Wiper 32 would wipe any excess mud that had been pulled out of the hole with the excess mud falling back into the bell nipple 75 and in effect returning down hole for further use. Following the portion of the drill pipe 35 moving out of first wiper 32, pipe 35 would then receive the initial spray of water 85 around its entire circumference, therefore thoroughly washing the wall 37 of the pipe as it moves through. Next, that portion of the pipe washed by water nozzles 60 would then move through the bore 34 of the upper wiper 50, which again would wipe away any excess water from the pipe 35 as the pipe is moved up through the upper wiper 50. Following the pipe exiting second wiper 50, the pipe may receive the chemical anti-corrosive compound spray to coat the wall 37 and would be then completely washed and chemically treated for being set aside until it would have to be returned down hole during use.

Of course, during this washing and chemical treatment process, a great deal of water and perhaps chemical compound is being flowed into the housing 12, and therefore must be retrieved. Therefore, as was described earlier, as the lower wiper 32 is being held in position within channel 30, the water flow flowing from nozzles 60 onto the wall of the drill pipe 35 would naturally flow down the wall onto the upper surface 31 of lower wiper 32, and must therefore flow out of the housing 12. Since as the drill pipe is moving upward, it would tend to pull lower wiper 32 upward to basically seal against the upper ledge 40, therefore receiving the water flow. Therefore, the upper ledge 40 would include fluid flow openings 41 at the juncture between the inner wall 29 of the housing 12 and the floor of ledge 40, so that as water flowing onto ledge 40 it would flow down through the flow bore 41 into trough 39. Since lower ledge 38 is actually a lower trough 39, having a fluid container portion 39A, any fluid flow flowing off of upper ledge 40 through the flow opening 41 would flow into lower trough 39. As noted in the Figures, each lower trough 39 would include a fluid exit line 90, for receiving the fluid flow from troughs 39 flowing the water back off of the rig, or into a pit adjacent the rig.

Likewise, upper plurality of nozzles 60 receive the anti-corrosive chemical compound fluid flow from chemical flow line 67, which would provide fluid to the the upper plurality of nozzles 60, and would provide the spray of the anti-corrosive fluid into the interior bore 16 of housing 12 so that the section of pipe moving upward out of the upper wiper 50 would be coated with the compound, so as to prevent corrosion of that section of pipe until further use. Upper trough 57 would receive the run off of the chemical fluid flow from the edge of upper wiper 50, and would likewise flow out of a chemical fluid exit line and would be returned to a reservoir positioned away from the system which would house the chemicals, so that the chemicals could be recirculated through the system and reused again.

Of course, it should be noted that not in all cases would the wipers 32 and 50 seal up against the upper ledges during the use of the system. Therefore, it is possible that any fluid flowing from above the wiper, down onto the upper surface of the wiper, would flow along the surface of the wiper down its edge, and directly into the trough contained below. For purposes of structure, the wiper would have approximately one inch fluid flow space between the inner annular wall 29 of housing 12 and the outer circular edge of the wipers, to allow this fluid flow off of the wiper and into the respective water or chemical troughs.

Figure 7:
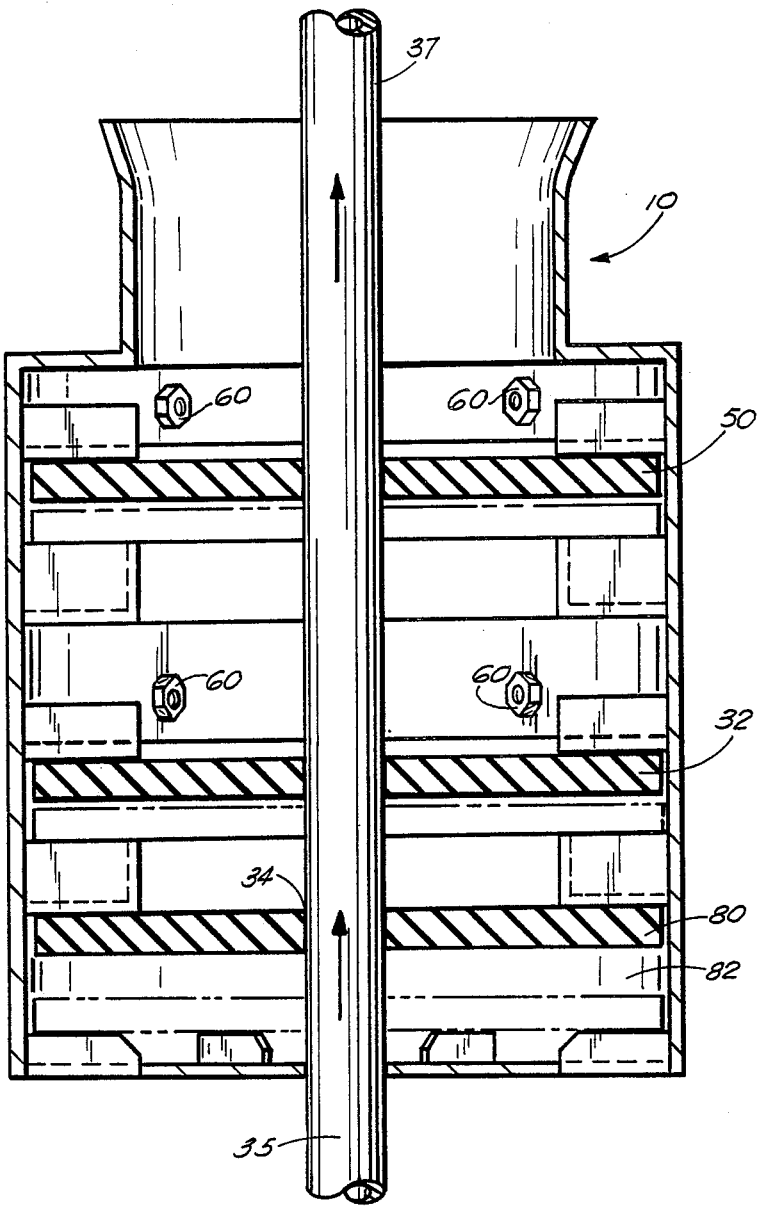
FIG. 7 is a cross-sectional view of an embodiment of the apparatus showing a plurality of three wipers in the apparatus.

In FIG. 7 there is illustrated an additional embodiment of apparatus 10 which is similar in structure to the embodiment illustrated in FIGS. 1–6. However, in this particular embodiment there is illustrated an upper wiper 50, an intermediate wiper 32, and the lower wiper 80, which is utilized in this particular embodiment. As seen in the FIGURE, there is a section of drill pipe 35 moving upward through the apparatus 10, with the wall 37 of pipe 35 engaging lower wiper 80 initially as the pipe moves up through the apparatus. This initial engagement of wiper 80, as the pipe moves through the wiper bore 34 would have the principal task of removing any mud that would be accumulated on the wall 37 of pipe 35, so that the mud falls directly into the bell nipple 75 and would not accumulate at the rig site. Therefore, particularly in the heavier accumulations of mud, lower wiper 80 would be useful in dislodging most of the mud from the wall 37 of pipe 35, prior to pipe 35 moving upward to engage intermediate wiper 32, to be washed via nozzles 60 and then engaging upper wiper 50 to be sprayed with the anti-corrosive compound prior to the pipe moving through the apparatus.

However, for purposes of functioning, this particular embodiment functions similarly to the preferred embodiment, and as in both embodiments, each of the wipers 32, 50, and 80, are interchangeable and may be moved from the various positions. It should be noted also, that unlike the preferred embodiment, there is no trough beneath lower wiper 80 as with the wipers 32 and 50, in view of the fact that since the primary function of the trough is to catch excess fluid flowing off of the wipers, there is the necessary space 82 below wiper 80 so that the mud may fall directly into the bell nipple and not be inhibited in its path.

For purposes of the apparatus, the apparatus could be constructed of any suitable material, preferably heavy gauge metal, the wiper contained therein would be a wiper which is found in the art, and has been utilized for this very purpose, but not in the context of this particular type of system. In addition, it is to be understood that any water flow or chemical flow flowing into the apparatus would be flowing under pressure via a system of pumps or the like, and has not been illustrated as the type of pump utilized would be common in the art, and would be available to anyone skilled in that art.

| NOMENCLATURE OF PARTS | NUMBER |
|---|---|
| Annular System | 10 |
| Housing | 12 |
| Circular Wall Portion | 14 |
| Bore of Housing | 16 |

-continued

| NOMENCLATURE OF PARTS | NUMBER |
|---|---|
| Semi-Circular Portions | 18/20 |
| Hinge Member | 22 |
| First Edge Portion | 24 |
| Locking Member | 26 |
| Inner Wall of Housing | 29 |
| First Annular Channel | 30 |
| Lower Wiper | 32 |
| Wiper Bore | 34 |
| Drill Pipe | 35 |
| Wiper Inner Edge | 36 |
| Wall | 37 |
| Lower Annular Ledge | 38 |
| Upper Annular Ledge | 40 |
| Fluid Flow Opening | 41 |
| Fluid Container Portion | 39A |
| Fluid Exit Line | 90 |
| Chemical Fluid Exit Line | 92 |
| Upper Wiper | 50 |
| Annular Channel | 52 |
| Lower Ledge | 54 |
| Upper Ledge | 56 |
| Upper Trough | 39 |
| Lower Trough | 57 |
| Lower Wiper Surface | 31 |
| Upper Wiper Surface | 51 |
| Nozzles | 60 |
| Spray Port | 62 |
| Lower Fluid Flow Line | 64 |
| Upper Fluid Flow Line | 65 |
| Common Flow Line | 66 |
| Chemical Common Flow Line | 67 |
| Surface | 37 |
| Mounting Base | 70 |
| Wall | 72 |
| Floor | 74 |
| Bell Nipple | 75 |
| Rig Floor | 76 |
| Bolt Member | 78 |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An apparatus for cleaning sections of a continuous string of drill pipe being tripped out of a hole, the apparatus comprising:

a. an annular housing positionable on the bell nipple under the rig floor, the housing surrounding the drill pipe moving therethrough, further comprising first and second semi-circular portions hingedly engaged along a common edge, the portions movable between a first open position and a second closed position;

b. wiper means in the housing, having a bore for frictionally engaging the wall of the pipe as the pipe moves through the wiper means;

c. an annular base member, positioned within the annular housing upon which the wiper means rest in the housing;

d. means for providing a pressurized spray of fluid onto the wall of the pipe after the pipe has moved through the wiper means in the housing; and e. means for wiping any excess water from the wall of the pipe following the spraying of the pipe with the pressurized fluid.

2. The apparatus in claim 1, wherein the housing further includes channel means along the interior wall of the housing for supporting the wiper means stationary within the housing as the drill pipe is moved therethrough.

3. The apparatus in claim 1, wherein the wiper means further includes a flat rubberized wiper, the bore of the wiper having a diameter so that the wall of the bore frictionally engages the wall of the pipe moving through.

4. The apparatus in claim 1, wherein there is further included an upper wiper member housed within a second channel for wiping the wall of the pipe a second time.

5. The apparatus in claim 1, wherein the means for providing pressurized fluid onto the wall of the drill pipe further includes a plurality of nozzle members positioned along the interior circumferential surface of the housing, and emitting a pressurized spray of water for washing any mud off of the edge of the wall of the pipe as the pipe moves through the lower housing.

6. The apparatus in claim 1, further including a second plurality of nozzles positioned along the circumferential wall of the housing above the upper wiper, for providing a spray of pressurized anti-corrosive chemical compound onto the wall of the drill pipe prior to its exiting the apparatus.

7. An apparatus for wiping, and chemically treating the wall of a continuous string of drill pipe being tripped out of the hole, the apparatus comprising:

a. an annular, substantially elongated housing, further comprising first and second semi-circular portions hingedly engaged along a common edge, the portions moved between a first open position, and a second closed position placed along the path of the drill string, so that the drill string moves through the housing as it is tripped from the hole;

b. first wiper means positioned within the housing when the housing is in the first open position, the wiper means including a bore along its central axis, and of a diameter to frictionally engage the wall of the drill pipe as the drill pipe moves through the housing;

c. a first plurality of fluid flow nozzles positioned within the wall of the housing above the lower wiper for providing a flow of pressurized water interiorly of the housing for washing the wall of the drill pipe moving therethrough;

d. a second wiper means likewise positioned within the housing and also including a bore along its central axis, and of a diameter to frictionally engage the wall of the drill pipe moves through the housing;

e. annular base members, each positioned within the elongated housing upon which the first and second wiper means rest in the housing; and f. a second plurality of fluid flow nozzles spaced along the interior wall of the housing above the second wiper means, for providing a flow of anti-corrosive chemical compound to coat the wall of the drill pipe as the pipe moves through the housing.

8. The apparatus in claim 7, wherein there is further included upper and lower troughs positioned directly below the upper and lower wipers respectively, said troughs receiving any excess fluid sprayed onto the wall of the pipe for removing the fluid from the housing during the treatment process.

9. The apparatus in claim 7, wherein there is further provided fluid flow lines into the housing for providing the fluid flow to the respective water and chemical compound nozzles.

10. The apparatus in claim 7, wherein when the housing is in the open position, the wipers may be removed from the housing, yet the housing maintained in the path of the drill pipe, without disturbing the upward or downward movement of the pipe during the drilling process.

11. An apparatus for wiping the wall of a continuous string of drill pipe being tripped out of the hole, the apparatus comprising:

(a) an annular housing positionable on the bell nipple under the rig floor, and placed along the path of the drill string, so that the drill string moves through housing as it is tripped from the hole;

(b) wiper means positioned within the housing, the wiper means including a bore along its central axis, and of a diameter to frictionally engage the wall of the drill pipe as the drill pipe moves through the housing;

(c) an annular base member, positioned within the annular housing upon which the wiper means rests in the housing;

(d) channel means along the interior wall of the housing for supporting the wiper means stationary within the housing as the drill pipe is moved therethrough; and (e) means positioned above the wiper means for mounting the wiper means within the housing during operation.

12. A system for housing a circular wiper of the type having a central bore therethrough, through which a continuous string of drill pipe moves as it is tripped out of the hole, the bore wall of the wiper engaging the wall of the pipe to clean the wall of the pipe, the system comprising:

(a) a bell nipple extending upward from the bore hole to a distance beneath the rig floor, including an annular wall, and open ended on its upper end;

(b) a container for the wiper, further comprising:

(i) a lower annular neck portion securably mountable on the upper end of the bell nipple;

(ii) an upper container body portion, formed by an annular side wall, and a floor portion, the container of sufficient diameter to house the wiper, including a space between the wall of the circular wiper and the side wall of the container;

(c) a plurality of spacers positioned on the floor of the container body portion, for supporting the wiper spaced apart from the floor, so that fluid wiped from the wall of the drill pipe flows through the space between the wiper and the wall of the container and onto the floor portion of the container to be returned into the bell nipple; and (d) means above the wiper for maintaining the wiper in the body portion while drill pipe is being wiped.

13. The container system in claim 12, wherein the annular wall of the container is of sufficient height so that fluid wiped from the drill pipe does not overflow the wall and flows beneath the wiper into the bell nipple.

* * * * *